US006450718B1

(12) United States Patent
Spruill

(10) Patent No.: US 6,450,718 B1
(45) Date of Patent: Sep. 17, 2002

(54) GOLF BAG PENCIL HOLDER

(76) Inventor: Paul Eric Spruill, 11253 Joyceton Dr., Largo, MD (US) 20774

( * ) Notice: Subject to any disclaimer, the term of this patent is extended or adjusted under 35 U.S.C. 154(b) by 0 days.

(21) Appl. No.: 09/930,220

(22) Filed: Aug. 16, 2001

Related U.S. Application Data

(60) Provisional application No. 60/231,531, filed on Sep. 11, 2000.

(51) Int. Cl.[7] ..... B43K 23/02

(52) U.S. Cl. ..... 401/131; 401/48; 224/918

(58) Field of Search ..... 401/131, 48, 195; 224/918, 274; 206/315.5, 315.3; 24/3.13, 11 F, 11 R, 11 FE

(56) References Cited

U.S. PATENT DOCUMENTS 264,593 A * 9/1882 Wright ..... 401/131
1,134,691 A * 4/1915 Martin et al. ..... 401/131
4,361,934 A * 12/1982 Darnell ..... 24/3 M
4,912,307 A * 3/1990 Sahde et al. ..... 235/123

* cited by examiner

*Primary Examiner*—David J Walczak
(74) *Attorney, Agent, or Firm*—Robert Halper

(57) ABSTRACT

A flexible marker holder is attached to a golf bag wherein an aperture in the upper region of the bag is gripped by a ring with a snap on hook attached thereto. A flexible member is joined to the hook by an eyelet, The flexible member descends through a diametric hole in a stabilizer, proceeds some distance past the stabilizer and terminates with a coupling adhesively fastened to the flexible member or integral therewith. The top end of a marker snuggly fits within the coupling. The hook, flexible member and coupling are preferably made of plastic. The stabilizer located between near the eyelet and the descending flexible member is designed to be immobilized.

8 Claims, 1 Drawing Sheet

GOLF BAG PENCIL HOLDER

This application supersedes application 60/231,531 filed on Sep. 11, 2000, and claims the benefit thereof under title 35 Unnited State Code 119(e)

This invention pertains to a Pencil holder for a golf bag.

BACKGROUND OF THE INVENTION

The prior art discloses a number of flexzible holders for pencils and the like but none specfically for golf bags. The following patents are exemplary of the art.

U.S. Pat. No. 1,134,691 teaches a pencil holder in the form of a clasp that can hold various size pencils.

U.S. Pat. No. 2,027,857 is described as a pencil stand whose purpose is to enable a pencil to be located on a table or desk so that it will be known at all times where to find and reach the pencil. Furthermore with the location of the pencil on a stand there is also avoidance of breakage of the pencil. The stand includes a glass base on which a coil spring formed column is supported. A series of balls in the column form an extensible retracting device that enables the column to return to its normal vertical position from a ninety degree bent position of its bottom portion with the article concurrently gravitating and depending from the free end of the column.

U.S. Pat. No. 4,588,317 is an example of a lead or pen marking device which could be used by a golfer for keeping scores. A plate member has an opening for receiving an endless string by which the device could be attached to a person's neck or wrist or shirt pocket.

U.S. Pat. No. 5,095,430 teaches a computer attached to a golf cart wherein a pen with a photosensor is attached at one end of a cord, where the other cord end is connected to the computer. The pen is a conventional input device used with computer screens to identify a certain location on the wcreen. The photosensor at the tip responds to peak illumination that occurs when the CRT screening spot passes its point of focus.

U.S. Pat. No. 5,360,342 illustrates a drawing board for children upon which is placed a coloring book or paper pad. Crayons are tethered to the board by an elastic cord, beadchain, or a coiled or straight monofilament nyon. The tether is attached to the crayon by a noose.

The art teaches a number of flexible markers such as pencils, etc. attached to a base enabling easy location of the pencil. There is also a marker for keeping golf scores, but such is connected to a golfer's neck, wrist or shirt pocket.

Accordingly it is an object of this invention to design a marker such as a pencil that is attached to a golf bag.

It is a further object of this invention to produce a flexible holder for the marker.

It is also an object of this invention to stabilize the holder attached to the bag.

SUMMARY OF THE INVENTION

The golf bag pencil holder comprises a ring inserted into an aperture located in a circumferential reenforcing strip. The reenforcing strip is adjacent the top of the golf bag. A snap hook engages the ring and has an eyelet at its distal end around which a flexible cord is looped. The looped cord then passes through a hole that extends diametrically through a golf ball. The golf ball serves to stabilize the flexible cord from excessive swing. The golf ball itself must be immobilized, and this is accomplished primarily by frictional force between the golf ball and flexible cord. After traversing the golf ball, the looped cord extends vertically downward and terminates in a coupling adhesively secured to the cord or integral therewith. The coupling fits around a top of a pencil or other type marker.

DETAILED DESCRIPTION OF THE INVENTION

Figure 1:
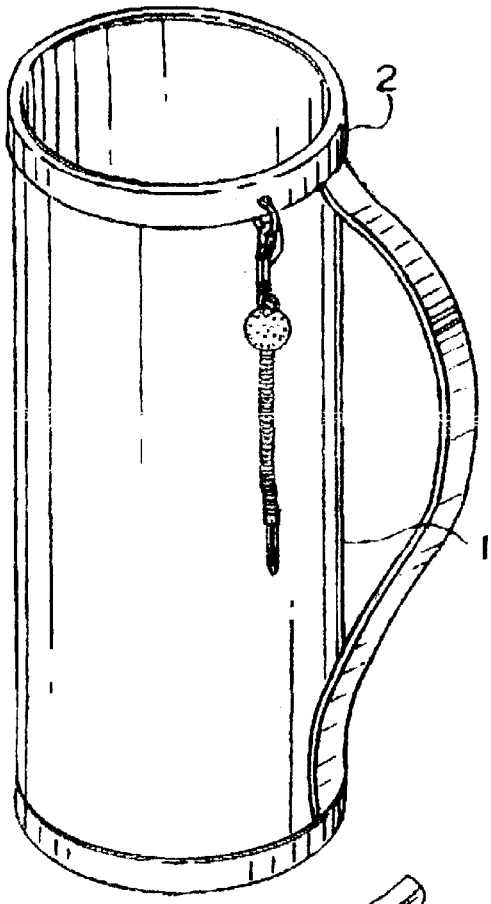
FIG. 1 is a front al view of the golf bag with the pencil holder assembly.
Figure 2:
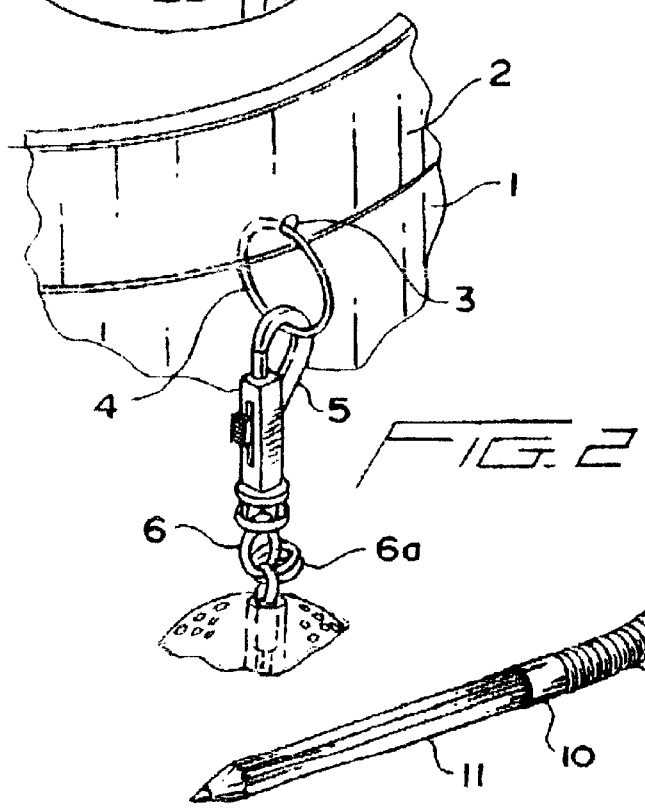
FIG. 2 is an enlarged view of attachment of a snap hook to the golf bag.
Figure 3:
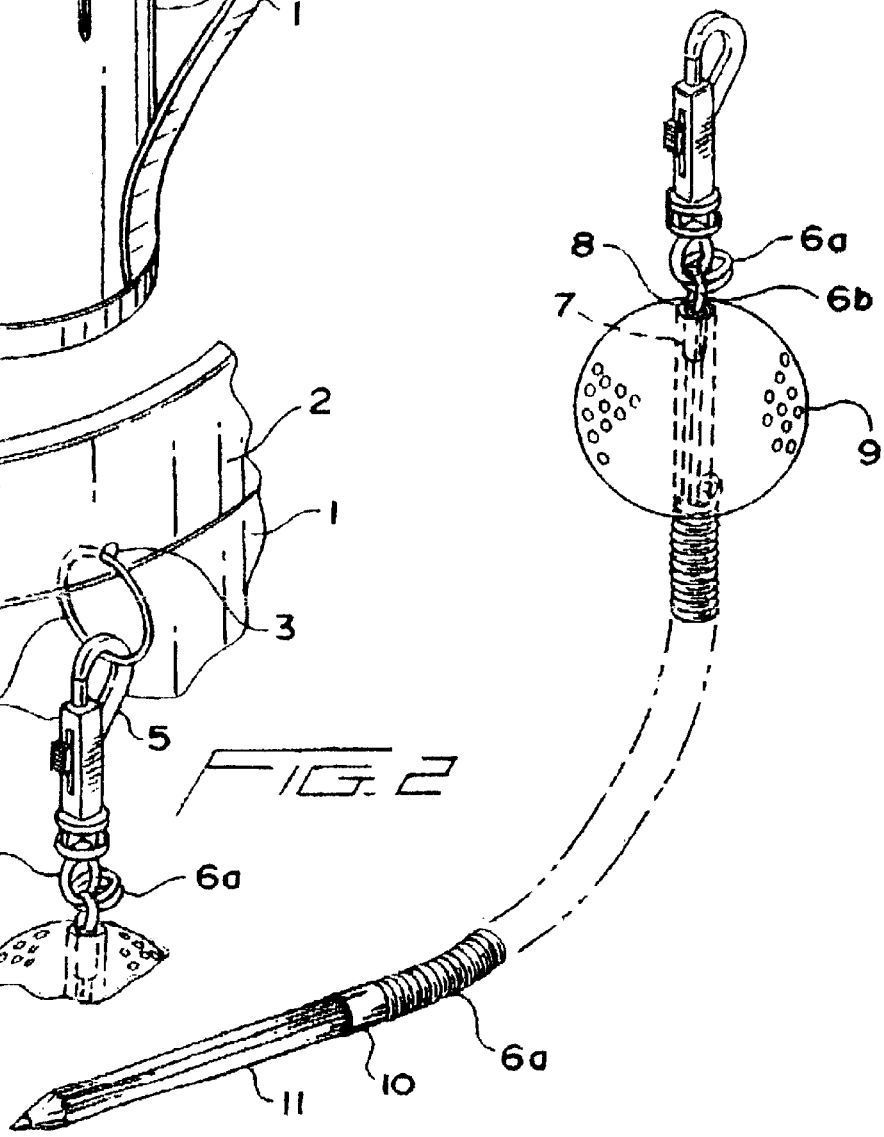
FIG. 3 is an enlarged view of the arrangement of the distal end of the snap hook, the looped cord and attachment to the pencil.

FIG. 1 shows a golf bag 1 having a circumferential reenforced strip 2 located adjacent the top of the golf bag. A small aperture 3 is located in the strip and a split ring 4 of the type used on key chains is placed through the aperture. A snap on hook 5 latches onto the ring. The hook ends in an eyelet 6 through which several loops 6*a* of a flexible cord pass. A first end 6*b* of the looped cord is engaged by an open ended sleeve 7 which is press fitted into a diametric hole in a golf ball. The loops adjacent the loops that pass through the eyelet then enter the diametric hole alongside the first end, traverse the length of the hole and extend as a one eighth inch diameter loop for about four and a half inches downwardly terminating in a coupling 10 that is integral with the looped cord, or is adhesively attached thereto. The coupling fits snuggly around the top of a pencil 11, The pencil can be readily removed from the coupling if necessary, or if one wishes to write independently of the golf bag. The golf ball acts to stabilize the flexible cord against excessive swing. At the same time the golf ball is immobilized between the several loops that pass through the eyelet and the looped cord that passes through the diametric hole. The diametric hole is about ¼" and the diameter of the cord is about ⅛", but as the looped cord passes through the diametric hole, it is subject to enough tension so that the sides of the looped cord frictionally engage the inner sides of the golf ball. Additionally, the first end of the looped cord and the loops adjacent the eyelet that enter the diametric hole alongside the first end of the looped cord both frictionally engage entirely the diametric hole. Finally the looped cord that has traversed the hole. would act as a stop to prevent the ball from sliding downwardly. The snap hook, the flexible cord and coupling are preferably made of a plastic or other light weight material could be used. Instead of using an elastic, looped cord, a coiled spring or chain might ber used. Similarly the marker could be a pen or the like, and the stabilizer could be a material that has a volume and density approximating that of the golf ball, although the golf ball is aesthetic and symbolic. It is obvious that many changes and modifications could be made that are likely to occure to one skilled in the art. It should be understood that the invention might be practiced otherwise and still fall within the scope of the appended claims.

I claim:

1. The combination of a flexible golf bag marker holder and a marker comprising:

a) a golf bag having an upper region, a circumferential reenforcing strip located in said upper region and a small aperture in said strip, b) a ring placed through said aperture and a snap hook attached thereto, an eyelet at a distal end of said snaphook, c) several loops of a flexible cord encircling said eyelet and having a first end, said first end embraced by a sleeve press fitted into a diametric hole in an immobilized stabilizer, a first group of said loops ending adjacent said first end and extending through said diametric hole, d) a second group of said loops of said fleixble cord extending vertically and downwardly some distance past said stabilizer and terminating in a coupling integral with said flexible cord, e) said coupling fitting around a top of said marker.

2. The combination of claim 1 wherein said stabilizer is a golf ball and means are provided for immobilizing said golf ball.

3. The combination of claim 2 wherein said means for immobilizing said golf ball comprises a tensioned loop cord in said diametric hole so that said tensioned cord frictionally engages inner sides of said ball adjacent said diametric hole.

4. The combination of claim 2 wherein said marker is a pencil.

5. The combination of claim 1 wherein said snap hook, said flexible Hoped cord and said coupling are made of plastic.

6. The combination of claim 1 wherein said flexible cord extends downwardly past said stabilizer for about four and a half inches and the diameter of said loops is about one eight inches.

7. The combination of claim 1 where said marker is removable and replaceable.

8. The combination of a golf bag pencil holder and pencil comprising, a) a golf bag having an upper region, a circumferential reenforcing strip located in said upper region and a small aperture in said strip, b) a ring placed through said aperture and a snap hook attached thereto, an eyelet at a distal end of said snaphook, c) a looped cord encircling said eyelet and passing in tension through a diametric hole in a golf ball stabilizer so as to frictioinally engage inner sides of said golf ball adjacent said hole, d) said looped cord extending loopwise after traversing said diametric hole for about four and a half inches and terminating in a coupling adhesively attached to said flexible cord, e) said coupling fitting snuggly around a top of a pencil, said pencil being removable and replaceable from said coupling.

* * * * *